United States Patent [19]

Malone et al.

[11] Patent Number: 4,901,617

[45] Date of Patent: Feb. 20, 1990

[54] HAND-HELD PERCUSSION INSTRUMENT

[76] Inventors: Kenneth M. Malone, 2805 Lincoya Dr., Nashville, Tenn. 37214; Samuel D. Bacco, 4804 Nevada Ave., Nashville, Tenn. 37209

[21] Appl. No.: 328,536

[22] Filed: Mar. 24, 1989

[51] Int. Cl.[4] ..... G10D 13/08

[52] U.S. Cl. ..... 84/402

[58] Field of Search ..... 84/402

[56] References Cited

U.S. PATENT DOCUMENTS

| | | | |
|---|---|---|---|
| 3,521,518 | 7/1970 | Cohen | 84/402 |
| 3,566,737 | 3/1971 | Gussack | 84/402 |
| 3,595,121 | 7/1971 | Magers | 84/470 |

FOREIGN PATENT DOCUMENTS

| | | | |
|---|---|---|---|
| 11063 | 6/1893 | United Kingdom | 84/402 |

*Primary Examiner*—Lawrence R. Franklin

*Attorney, Agent, or Firm*—Mark J. Patterson

[57] ABSTRACT

A hand-held percussion device which can make different sounds when shaken, struck, or scraped is now available. The device comprises a frame that is made of two sound boards interconnected and separated by a top block on one end and joined on the other end. Between the top and bottom of the device, a bridge interconnects and separates the sound boards thereby determining their length and tension. The bridge also creates at least two separated sound chambers in the frame. A top plate is placed over the upper side of the sound boards and a lower plate is placed over the bottom side of the sound boards. The top plate and bottom plate, respectively, can be separated from the sound boards by use of spacers. Filler materials such as "BBs" or other bead-like materials can be placed within one or more of the chambers thereby allowing the device to make noise when vibrated. Tone prongs are placed in one or more of the chambers thereby creating an entirely different sound when the filler material strikes against the tone prongs and sound boards, or plates. The device is shaped in such a way as to make it easily hand-held.

7 Claims, 2 Drawing Sheets

HAND-HELD PERCUSSION INSTRUMENT

BACKGROUND OF THE INVENTION

This invention relates generally to musical percussion instruments and more particularly to a percussion instrument that fits comfortably into one's hand that in its various manifestations can be struck, shaken, scraped, bowed or plucked in many different ways to produce a virtually unlimited array of musical effects.

It will be appreciated by those skilled in the art that percussionists desire the ability to produce many different sounds depending upon the type of the music. To this end, there have been several attempts to provide such a variety of sound. One such attempt is U.S. Pat. No. 4,165,671 issued to E. A. DeBose, Aug. 28, 1979. This percussion instrument has two cylindrical chambers containing beads. The instrument can double as a record stand. Although this percussion instrument is unique, it is limited in the sounds that it can make. The only sound that can be made is by rattling the beads within the hollow tubes.

U.S. Pat. No. 4,269,105 issued to J. E. Salmon on May 26, 1981 discloses a grooved stick that has tambourine jingles attached to it. When a stick is run across these grooves, a jingling and ratchet sound is made. This instrument is very restricted in the sounds that can be made. Further, the instrument is only properly used when shaken or scraped.

The variety of other inventions of rhythm instruments is endless. For example, several use chambers filled with beads. Examples of these are U.S Pat. No. 4,179,973 issued to W. C. White on Dec. 25, 1979 and U.S. Pat. No. 4,306,485 issued to A. Rudkin on Dec. 22, 1981. However, both are limited in the type of noise made. Further, both are limited to shaking.

Others make sounds from being hit. One example of this is the percussion noise maker issued to L. Marks as U.S. Pat. No. 4,658,694 on Apr. 21, 1987. This device has merely two divergent rods hooked together at a base with clapper knobs at the ends. One clapper knob is hit thereby causing contact with the other clapper rod. Further, U.S. Pat. No. 3,439,572 issued to M. B. Cohen on Apr. 22, 1969 discloses an instrument that has a ball which is struck thereby making a rattling sound.

However, all of these prior inventions are limited to either being hit or shaken or scraped. A few combine two of those playing types. None combine all three or offer a wide variety of sounds.

SUMMARY OF THE INVENTION

It is an object of the present invention to provide a hand-held percussion instrument that fits comfortably into one's hand.

It is a further object of the present invention to provide a hand-held percussion instrument that can produce a wide variety of sounds by use of interchangeable and adjustable components.

Still a further object of the present invention is to provide tone prongs within the sound chamber that make different sounds when struck by different materials.

Another object of the present invention is to enhance the response of the instrument sound boards by the sympathetic vibrations of the tone prongs.

Still a further object of the present invention is to provide a hand-held percussion device that can be operated by being shaken, struck, scraped, bowed or plucked.

In the present device, a generally Y-shaped hand-held percussion instrument is constructed by forming a frame comprising two sound boards joined at the bottom and separated at the top by a block. The two sound boards are curved and secured under tension. A top plate covers the upper side of the frame and a bottom plate covers the lower side of the frame, thereby defining two sound chambers above and below a bridge separating the sound boards at approximately midpoint. These chambers are filled with beads, "BBs", seeds, or any other loose material. Tone prongs are attached to the bridge inside one of these chambers thereby producing unique sounds when the loose material hits the tone prongs or sound boards. Spacers between the frame and plates create a sound enhancing opening which can be partially adjusted by flexion of the plates or covering of the opening with the hand.

DESCRIPTION OF THE PREFERRED EMBODIMENT

Figure 1:
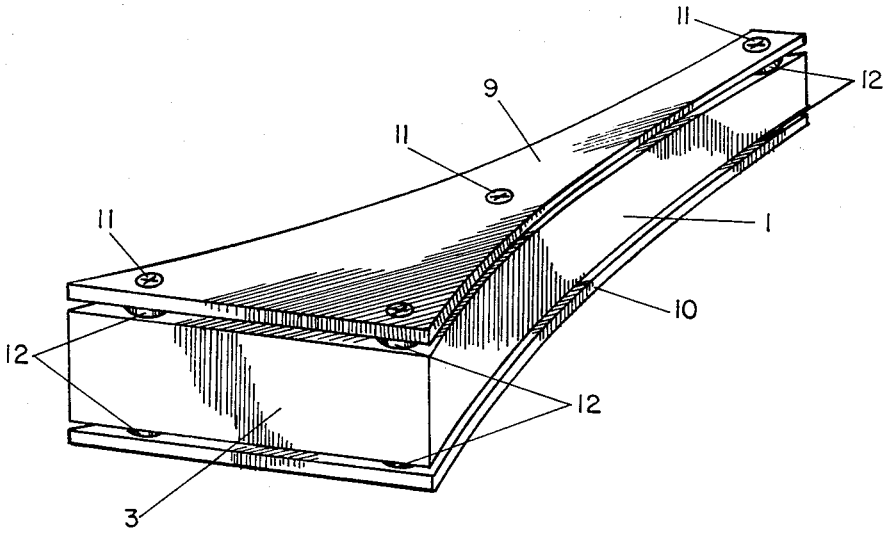
FIG. 1 is an isometric view of the hand-held percussion instrument.
Figure 2:
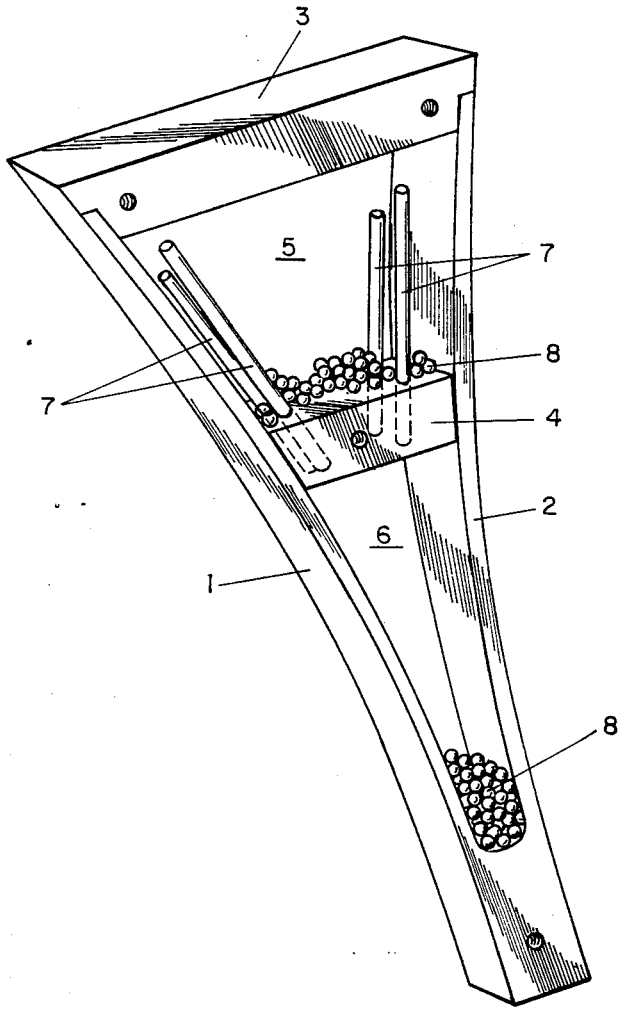
FIG. 2 is an isometric side view of the hand-held percussion instrument with the top and bottom plates removed.
Figure 3:
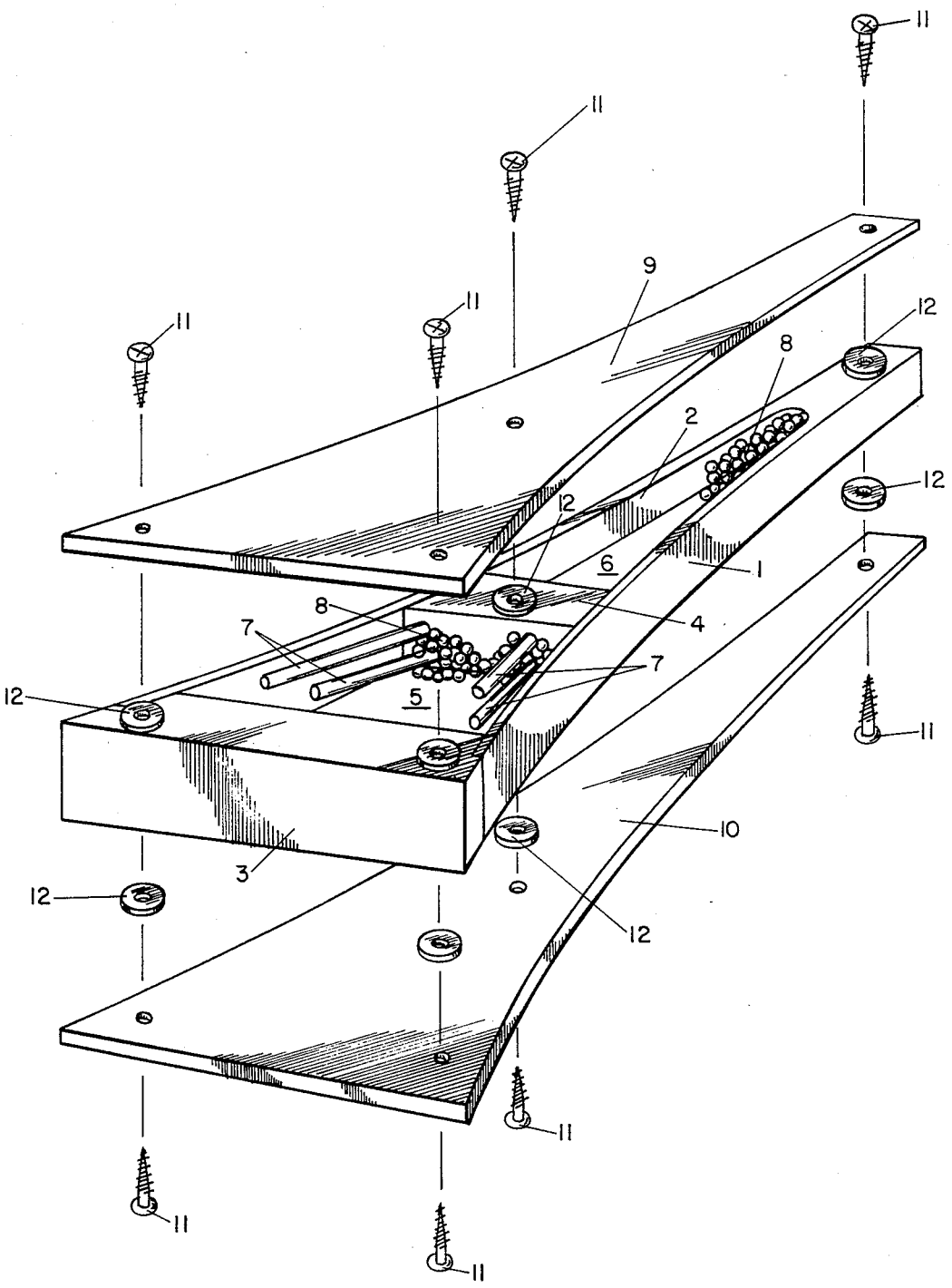
FIG. 3 is an exploded isometric view of the hand-held percussion instrument.

Referring to FIGS. 1, 2 and 3, there is shown the hand-held percussion instrument of the present invention comprising generally sound boards 1 and 2 joined together at their lower ends and separated at their upper ends by block 3, forming a generally Y-shaped instrument which is typically gripped at the lower end of sound boards 1 and 2. Attached to and separating the sound boards 1 and 2 at their approximate midpoint is bridge 4, thereby defining upper and lower sound chambers 5 and 6. Further enclosing sound chambers 5 and 6 are top and bottom plates 9 and 10 which are attached using screws 11 to sound boards 1 and 2 and bridge 4. Annular spacers 12, which surround screws 11 separate plates 9 and 10 from sound boards 1 and 2 creating gaps around the circumference of the instrument.

Extending upwardly from bridge 4 into upper chamber 5 are plural tone prongs 7. Placed within enclosed upper and lower chambers 5 and 6 is filler material 8 which in the preferred embodiment comprises steel BBs.

The unique and variable sounds produced by the present invention are a function of the novel shape of the instrument, the use of plural sound chambers with internal filler material, and the use of tone prongs. Further, the instrument of the present invention is designed in such a way that a great variety of sounds can be achieved by substitution and/or flexing of the materials used.

Thus, in the present invention, sound boards 1 and 2 are preferably machined from a single piece of walnut which, while under tension, are glued to the sides of block 3, also made of walnut. Tensioning of sound boards 1 and 2 is a key factor in the unique sound obtained from the instrument.

Bridge 4 functions as a means of transmitting vibrations from sound boards 1 and 2 to tone prongs 7 and vice versa. Experimentation has shown that gluing of bridge 4 to a point approximately midway up the divided portions of sound boards 1 and will 2 will provide the optimum sound, although other musicians may preferably alternative placement.

Tone prongs 7, preferably made of ⅛" drill rod, are pressed within bridge 4 and preferably placed at an angle approximately parallel to the angle of sound boards 1 and 2. Preferably, the instrument will have the maximum number of tone prongs allowed by the space provided along bridge 4. However, it is important to leave enough space between the prongs to allow filler material 8 to hit both bridge 4 and sound boards 1 and 2 adjacent to prongs 7. It should be noted that the gauge and length of tone prongs 7 can be varied to change the overall tonal quality of the instrument. Thus, for example, if prongs 7 are attached to bridge 4 by threaded means, the player of the instrument can quickly alter the tone of the device by removing or adding tone prongs as desired or substituting prongs of different diameters or lengths.

Although the use of steel BBs as material for filler 8 produces a preferred sound, other materials such as seeds, shot, et cetera, can be used to alter the sound. Again, it is important that the diameter of the material comprising filler 8 be such that filler 8 can pass between prongs 7. In addition, for further variety in sound, prongs comprising hollow tubes, springs, or even strings secured to block 3 could be substituted.

Further sound enhancement is produced by top and bottom plates 9 and 10 which are preferably made of birch panels of approximate ¼" thickness. The use of spacers 12, preferably of a flexible material such as rubber or neoprene to create gaps between plates 9 and 10 and sound boards 1 and 2 provides further flexibility and variety in sound. Suspension of plates 9 and 10 by spacers 12 also varies the sound of the instrument by allowing the plates to vibrate more freely. For example, the user of the instrument can, while shaking the instrument, cover a portion of the gaps created by spacers 12 with the cupped hand to partially muffle or mute the sound. Similar yet different effects can be created by inward flexing of plates 9 and 10 through hand pressure, thereby altering the shape or location of the gaps created.

The use of screws 11 to assemble the instrument allows the instrument player to quickly disassemble it and, for example, remove spacers 12 to eliminate the gaps. This creates an even different sound. Plates 9 and 10 of different material, thickness, texture, et cetera, can be substituted to vary the sound as well. Thus, the instrument could be manufactured of plastic or metal in whole or in part.

It should also be noted that the instrument can be struck with the hand or a stick in addition to being shaken.

Finally, in the preferred embodiment, the instrument is approximately 10¾" in length, 4" wide at block 3, and ¾" wide at the lower joinder of sound boards 1 and 2. The overall thickness of the instrument, with spacers 12 defining gaps between plates 9 and 10 and sound boards 1 and 2 of approximately 1/16", is 1.5". However, smaller or larger instruments can be made, and more than two sound chambers included, without departing from the scope of the present invention.

What is claimed is:

1. A hand-held percussion instrument comprising:

(a) dual sound boards joined at their lower end and separated at their upper end by a block to form generally a "Y" shape;

(b) at least one bridge joining said sound boards thereby defining plural sound chambers between said sound boards and above and below said bridge;

(c) tone prongs attached to and extending from said bridge into at least one of said sound chambers;

(d) top and bottom plates attached to said sound boards and said bridge to enclose said sound chambers; and (e) filler particles enclosed within at least one of said sound chambers, said particles adapted for noise-making contact with said tone prongs, said bridge, said sound boards, and said plates when said instrument is vibrated.

2. The instrument of claim 1 further comprising means interposed between said plates and said sound boards for creating an external gap communicating with said chambers.

3. The instrument of claim 2 where said gap-creating means are removable.

4. The instrument of claim 1 where said sound chambers above and below said bridge are approximately equal in linear dimension along said sound boards.

5. The instrument of claim 1 where said sound boards are under tension when said instrument is assembled.

6. The instrument of claim 1 where said tone prongs are approximately linearly aligned with said sound boards.

7. A hand-held percussion instrument comprising:

(a) dual sound boards joined at their lower end and separated at their upper end by a block to form generally a Y-shaped instrument, said sound boards placed under tension by said block;

(b) at least one bridge joining said sound boards at their approximate linear midpoint and defining plural sound chambers between said sound boards and above and below said bridge;

(c) tone prongs attached to and extending from said bridge into at least one of said sound chambers, said prongs approximately linearly aligned with said sound boards;

(d) top and bottom plates removably attached to said sound boards and said bridge to enclose said sound chambers, said removable attachment means including removable spacers for creating gaps between said plates and said sound boards;

(e) filler particles enclosed within at least one of said sound chambers, said particles adapted for noise making contact with said tone prongs, said bridge, said sound boards, and said plates.

* * * * *